US009643079B2

(12) United States Patent
Spurgeon

(10) Patent No.: US 9,643,079 B2
(45) Date of Patent: May 9, 2017

(54) MODIFIED CHESS GAME WITH ADDITIONAL GAME PIECES

(71) Applicant: Richard M. Spurgeon, Southfield, MI (US)

(72) Inventor: Richard M. Spurgeon, Southfield, MI (US)

( * ) Notice: Subject to any disclaimer, the term of this patent is extended or adjusted under 35 U.S.C. 154(b) by 220 days.

(21) Appl. No.: 13/896,034

(22) Filed: May 16, 2013

(65) Prior Publication Data

US 2013/0252685 A1 Sep. 26, 2013

Related U.S. Application Data

(63) Continuation-in-part of application No. 13/293,436, filed on Nov. 10, 2011, now abandoned, which is a continuation-in-part of application No. 12/446,325, filed as application No. PCT/US2007/081888 on Oct. 19, 2007, now abandoned.

(60) Provisional application No. 60/862,891, filed on Oct. 25, 2006, provisional application No. 61/792,359, filed on Mar. 15, 2013.

(51) Int. Cl.

| | |
|---|---|
| ***A63F 3/02*** | (2006.01) |
| ***A63F 3/04*** | (2006.01) |
| ***A63F 3/00*** | (2006.01) |
| ***A63F 9/00*** | (2006.01) |

(52) U.S. Cl.
CPC *A63F 3/02* (2013.01); *A63F 3/04* (2013.01); *A63F 9/0098* (2013.01); *A63F 2003/00779* (2013.01)

(58) Field of Classification Search
None
See application file for complete search history.

(56) References Cited

U.S. PATENT DOCUMENTS

| | | | | |
|---|---|---|---|---|
| 4,613,134 | A * | 9/1986 | Tobin | 273/242 |
| 5,690,334 | A * | 11/1997 | Duke | 273/261 |
| 8,302,969 | B2 * | 11/2012 | Srinivasa | A63F 3/00643 273/255 |
| 2005/0285339 | A1 * | 12/2005 | Park | 273/260 |
| 2006/0022404 | A1 * | 2/2006 | Imai | 273/236 |
| 2010/0327528 | A1 * | 12/2010 | Spurgeon | A63F 3/02 273/260 |
| 2013/0244784 | A1 * | 9/2013 | Assa | G06F 3/0488 463/40 |

* cited by examiner

*Primary Examiner* — Kang Hu
*Assistant Examiner* — Robert T Clarke, Jr.
(74) *Attorney, Agent, or Firm* — Fishman Stewart PLLC

(57) ABSTRACT

A chess-like game having pieces and rules similar to conventional chess but which includes a new piece having powers and limitations not present in conventional chess pieces.

20 Claims, 10 Drawing Sheets

| | | | | | | | | | |
|---|---|---|---|---|---|---|---|---|---|
| | X | | | | | | X | | X |
| | | X | | | | X | | X | |
| | | | X | | X | | X | | |
| | | | | W | | X | | | |
| | | | X | | B | | | | |
| | | X | | X | | X | | | |
| | X | | X | | | | X | | |
| X | | X | | | | | | X | |

Fig. 5

| | | | | | | | | | |
|---|---|---|---|---|---|---|---|---|---|
| | X | | | | | | X | | X |
| | | X | | | | X | | X | |
| | | | X | | X | | X | | X |
| | | | | W | | X | | X | |
| | | | X | | B | | X | | |
| | | X | | X | | W | | | |
| | X | | X | | X | | X | | |
| X | | X | | X | | | | X | |

Fig. 6

| | | | | | | | | | |
|---|---|---|---|---|---|---|---|---|---|
| | | | | | | | | | |
| | | | X | | X | | | | |
| | | X | | | | X | | | |
| | | | | W | | | | | |
| | | X | | | | X | | | |
| | | | X | | N | | | | |
| | | | | | | | | | |
| | | | | | | | | | |

Fig. 7

| | | | | | | | | | |
|---|---|---|---|---|---|---|---|---|---|
| | | | | | | | | | |
| | | | X | | X | | | | |
| | | X | | | | X | | | |
| | | | | W | | C | | | |
| | | X | C | | | X | C | | |
| | | | X | | N | | | | |
| | | | C | | | | C | | |
| | | | | C | | C | | | |

Fig. 8

MODIFIED CHESS GAME WITH ADDITIONAL GAME PIECES

CROSS REFERENCE TO RELATED APPLICATIONS

This Application is a Continuation-in-Part of U.S. patent application Ser. No. 13/293,436, filed Nov. 10, 2011, which is a Continuation-in-part of U.S. patent application Ser. No. 12/446,325 filed on Apr. 20, 2009, now abandoned, which is a U.S. National Phase Application of PCT/US2007/081888, which claims the benefit of U.S. Provisional Application 60/862,891 filed on Oct. 25, 2006. The present application also claims priority to U.S. Provisional Application 61/792,359, filed on Mar. 15, 2013. The contents of all of the above applications are incorporated herein by reference.

FIELD OF INVENTION

The present invention relates to a board game and more particularly to a modified chess game.

BACKGROUND OF THE INVENTION

State of the art

Traditional chess is a game requiring strategy. It provides the pleasure of analytical thought and has been used by schools to help develop analytical thinking However, some players, including the great champion Capablanca, have felt a need for some modification of the conventional game of chess.

There are numerous prior art patents that disclose variations of the traditional game.

U.S. Pat. No. 4,093,237 issued to Gary Weiss in 1976 discloses a chess game that can be played by more than two players.

U.S. Pat. No. 4,553,756 issued to Robert L. Linnekin in 1983 discloses a chess game that is played with a circular board.

U.S. Pat. No. 5,125,666 issued to Timothy Adams in 1992 discloses a modified chess game that is played by four players.

U.S. Pat. No. 5,033,753 issued to Tom Yuen et al. in 1992 discloses a game similar to chess but which includes a number of pieces not found in chess. The rules for the game are quite different than those of traditional chess.

U.S. Pat. No. 5,484,157 issued to Michael King in 1994 discloses a chess game in which military pieces are substituted for the traditional chess pieces.

U.S. Pat. No. 5,662,329 issued to Richard Nason in 1997 discloses a chess game utilizing a three-dimensional game board.

U.S. Pat. Nos. 5,690,344; 5,692,754; 5,901,957 and 6,095,523 each disclose modified chess games in which pieces with powers not provided to traditional pieces are included as part of the game.

U.S. Pat. No. 5,690,334 issued Nov. 25, 1997 discloses a chess variant denoted as Falcon chess. Falcon chest includes an extra game piece called a "falcon" which can be moved in straight and diagonal movements.

U.S. Pat. No. 6,116,602 issued in September 2000 discloses a four handed chess set with a number of additional pieces but with no piece equivalent to the beast of the present invention.

The Encyclopedia of Chess Variants by D. B. Pritchard Published by Games & Puzzles Publications, P.O. Box 20, Godalming, Surrey GU8 4YP, United Kingdom. This provides information concerning other variations of traditional chess.

While numerous modifications of traditional chess have been provided, none have included the modifications provided by the present invention.

SUMMARY OF THE INVENTION

The game of the present disclosure is related to traditional chess but has an additional type of piece with, e.g., assigned, properties such as expanded powers different than the powers of traditional chess pieces. The additional piece is labeled "W" and is referred to as a "beast" for purposes of the present disclosure.

Unlike Falcon chess where the piece called a "falcon" can only move straight and diagonally the "beast" of the present Chess variant, called Tensor Chess, blocks opposing pieces and shields its own like-colored pieces while allowing its own players to pass through the piece. The beast also allows its own pieces to "bounce" i.e. Shift movement in new directions. The beast can be "propelled" if one of its own pieces lands on a square occupied by a beast. The beast, on the same turn, can be sent off the square, moving in the manner of the piece that landed on the square.

The pieces disclosed in U.S. Pat. No. 6,116,602 have enhanced powers but none have the powers provided to the beast of the present application.

BRIEF DESCRIPTION OF THE DRAWINGS

A better understanding of the game of the present invention can be had by referring to the drawings in which:

FIG. 5 is a diagram similar to FIG. 4 illustrating the permissible movements of a bishop using a beast in the modified chess game of the present invention; and FIG. 6 is a diagram similar to FIG. 5 but illustrating additional permissible moves of a bishop when the bishop has the option of using either of two beasts in the modified chess game of the present invention; and FIG. 7 is a diagram illustrating permissible movements of a knight using a beast in the modified chess game of the present invention; and FIG. 8 is a diagram similar to FIG. 7 but illustrating permissible moves of a knight using a beast and permissible moves of a knight that are also allowed in conventional chess.

DETAILED DESCRIPTION OF THE PREFERRED EMBODIMENTS

Figure 1:
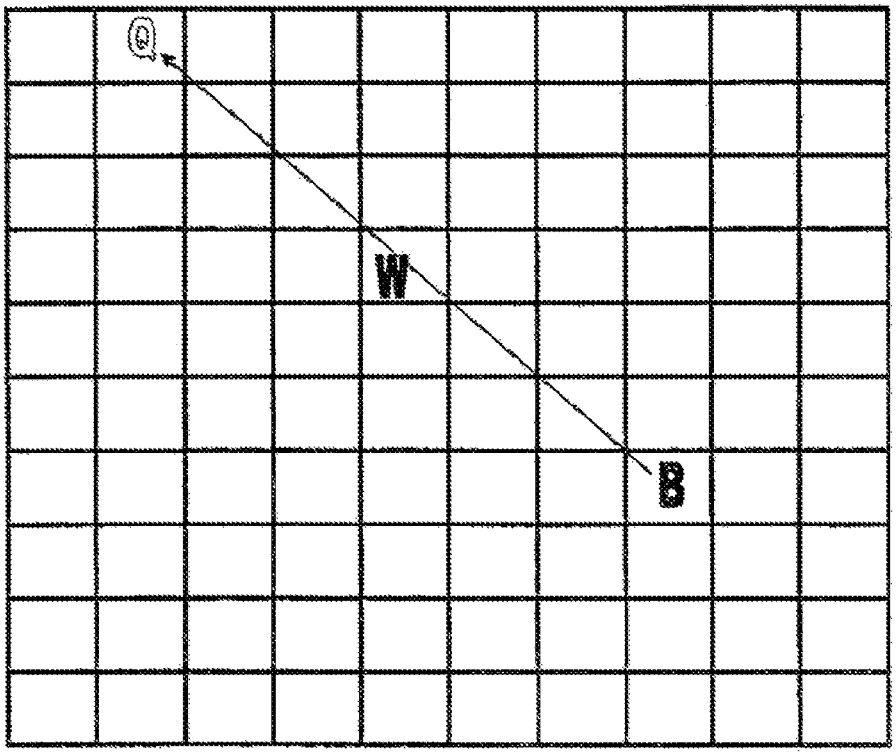
FIG. 1 is a diagram illustrating how a bishop can pass through the additional piece called the beast (if the same color) and attack an opposing piece.

Referring to FIGS. 1-19, a method of playing a modified chess game in accordance with the rules of the present invention is illustrated. The game board in the first preferred embodiment is in the form of a conventional chessboard with an additional two files/columns and the pieces are conventional pieces except for an additional type of piece designated herein as a beast. A vertical column eight squares deep would make up a file. A rank or row would be comprised of ten squares running horizontal to the files. For the sake of description and better understanding, the files could be labeled A to J and the ranks 1 to 8. The square at the left hand corner of the player with the light colored pieces would be A1.

In the drawings the pieces are designated as follows:

W denotes the beast piece
Q denotes a queen
B denotes a bishop
P denotes a pawn
K denotes a king
R denotes a rook
N denotes a knight While the board is shown in the drawings as having squares all of the same color, it is intended, at least in the preferred embodiment that is now being described, that a two-color chessboard be used. The board is being shown as not including colored squares to avoid confusion in describing the position and movement of the pieces of the modified chess game of the present invention.

In general the rules of traditional chess apply to the modified chess game of the present invention unless otherwise noted.

The conventional pieces are provided except that an additional type of piece, a beast W, is provided for each player, each player getting two such beast pieces. The conventional pieces, in addition to having, e.g., being assigned, properties such as all of the traditional powers of movement, capture and promotion, have, e.g., may be assigned, properties such as augmented powers as will be apparent as the description proceeds.

The beast cannot capture or be captured by anything except an opposing beast. Other pieces, including another beast, are able to 'pass through' a beast of the same color, i.e., move along the piece's normal line of movement as if the beast were not there; but opposing pieces, other than a beast (or a knight), are unable to pass through or over a beast of another color. Thus a beast acts as a shield for pieces of its own color but allows pieces of the other color to be attacked. FIG. 1 illustrates this by showing a bishop B attacking an opposing queen Q through a beast W while the queen Q cannot move through the beast W to attack the bishop B since the bishop B is shielded by beast W. The bishop and the beast are the same color. The square on which the moving piece lands, however, must be a square to which the piece could have moved if the beast had not been in between. The power of a king or pawn to pass through a beast is more restricted than that of other pieces. The king may pass through only when castling. A pawn may pass through only on its first move. As in regular chess, a pawn may move to the fourth rank/row on its first move, and in this variant it may pass through a beast on the third rank to do so.

Figure 2:
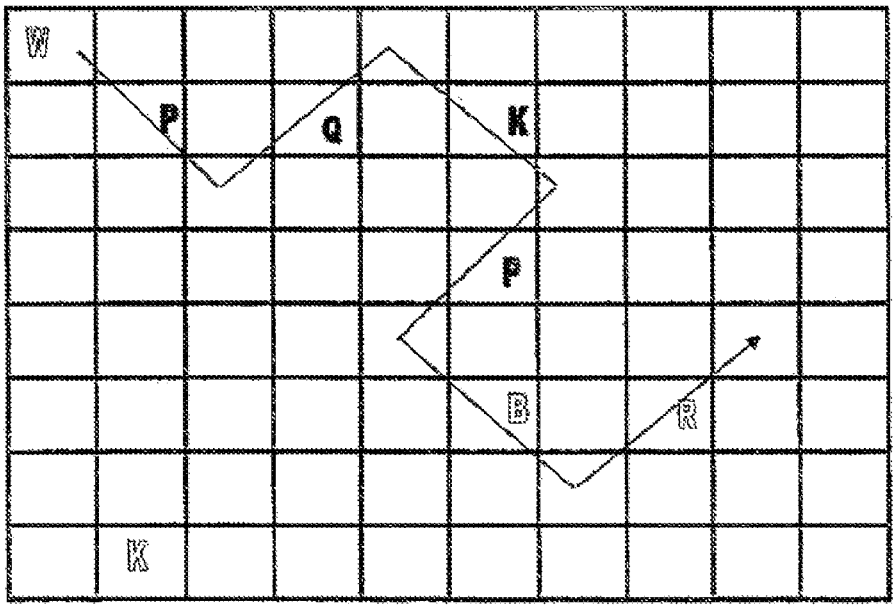
FIG. 2 is a diagram illustrating permitted diagonal moves of a beast of the modified chess game of the present invention.
Figure 3:
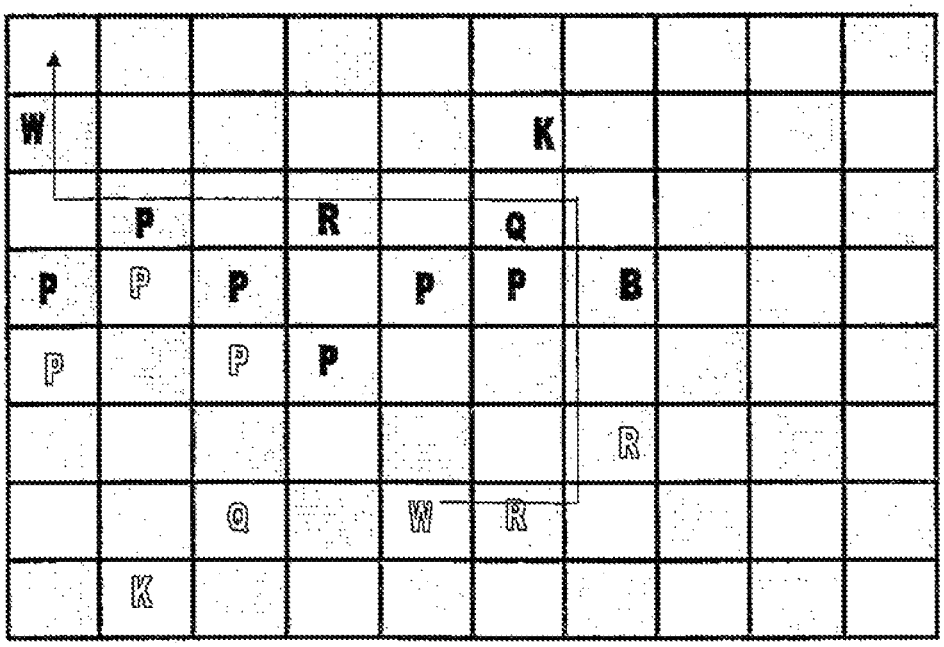
FIG. 3 is a diagram illustrating permitted orthogonal moves of a beast and how the beast can capture opposing pieces in the modified chess game of the present invention.

The beast is able to move one square in any direction to an unoccupied adjacent square. The beast is also able to move by hopping or leaping over its own adjacent or opposing adjacent pieces either diagonally as in checkers or orthogonally (along a rank or file), but not orthogonally and diagonally on the same turn. The beast is able to make multiple leaps in a given turn and by leaping could even move forward, backward, and sideways orthogonally on the same turn or diagonally forward and backward. The beast is able to capture an opposing beast by leaping over it and landing on the square beyond if that square is unoccupied. But capturing is not obligatory when making such a leap. FIG. 2 illustrates a beast W leaping diagonally and beast W as shown in FIG. 2 moves from one corner of the board to almost the opposite corner moving over the opposing pawns P, queen Q and king K and its own pieces bishop B and rook R. The moving beast and the other pieces of that player are shown as lighter than the opposing player's pieces. FIG. 3 illustrates the beast W leaping orthogonally to capture an opposing beast W at the end. As shown in FIG. 3 the beast W captures the opposing beast W with its final leap having first leaped over two of its own rooks R, and an opposing queen Q, bishop B, rook R and pawn P. Again, the moving beast and the other pieces of that player are shown as lighter than the opposing player's pieces.

As described in more detail below, a bishop, knight, rook or queen may 'bounce' or ricochet off one of its own beasts. This maneuver is also referred to as a 'beast bounce' although the other piece ricochets off a stationary beast. Kings and pawns cannot bounce. A beast may bounce off a beast of the same color if the first beast initially moves one square (no hop) to get to the square occupied by the second beast, bounces at a right angle to its prior line of movement, and ends adjacent to the second beast. There is a limit of one bounce to a turn no matter what type of piece bounces. Captures can be made at the end of a bounce except by a beast bouncing off another beast.

Figure 4:
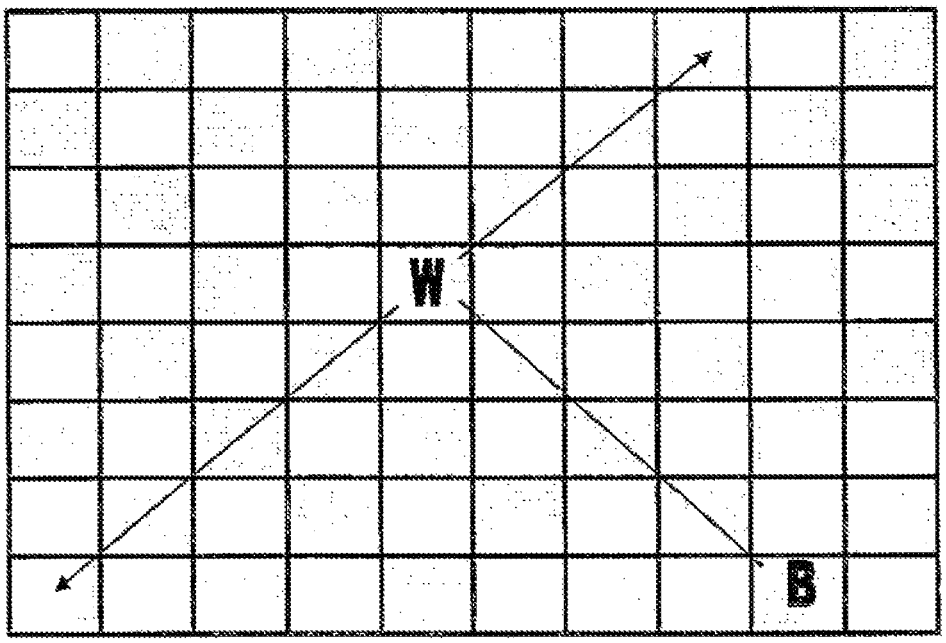
FIG. 4 is a diagram illustrating how a bishop can use the beast to move to different squares.

As best seen in FIG. 4, once during a player's turn, a bishop B can bounce off one of its own beasts W, so that the bishop B comes to the square occupied by the beast W and then moves off at a right angle. Note as illustrated in FIG. 4, the bishop B can bounce off the beast W in one of two possible directions. FIG. 5 illustrates the squares X to which a bishop B could move under conventional rules and the squares X to which it could move using a beast W. The Xs denoting squares accessible through a beast bounce are lighter in tone than those denoting those accessible through conventional movement.

FIG. 6 illustrates the options open to the bishop B using conventional movement or bouncing off of one of either of the two beasts each denoted with a W. The bishop B could move to squares denoted with darker toned Xs using the conventional rules and to squares denoted by lighter toned Xs by bouncing off either beast marked W. The Xs denoting squares accessible through a beast bounce are lighter in tone than those denoting those accessible through conventional movement.

As best seen in FIG. 7, a knight N can make a beast bounce by coming to a square occupied by one of the beasts W and then making a further knight move to any one of the squares X. A player can make only one beast bounce on a given turn. FIG. 8 illustrates the squares X to which a knight N could move by bouncing off of a beast W and the squares C to which it could move under conventional rules. The diagram illustrates the greatly increased range and power of the knight N under the game of the present invention.

Figure 9:
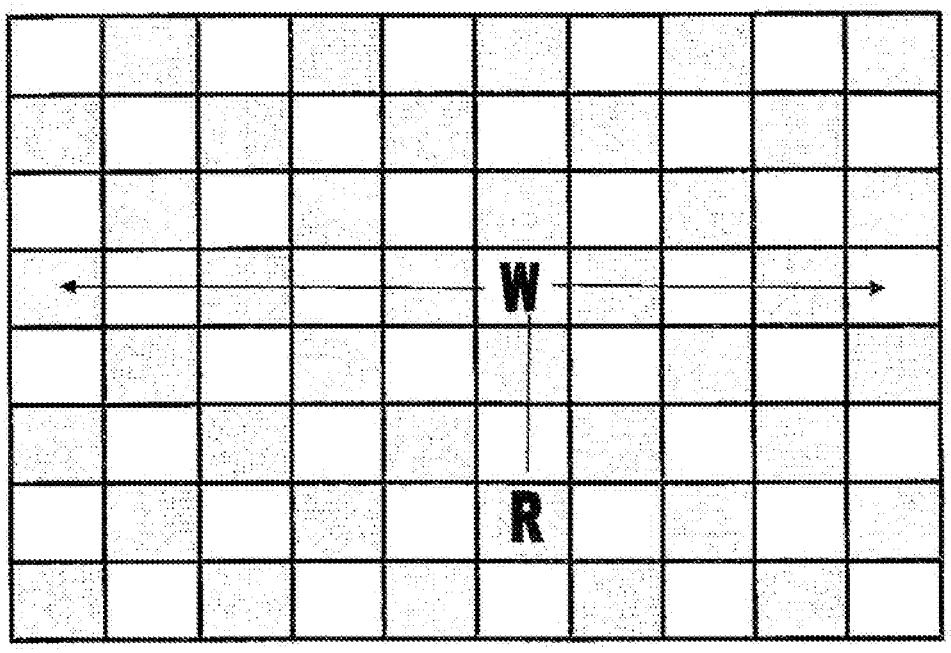
FIG. 9 is a diagram illustrating permissible movements of a rook using a beast in the modified chess game of the present invention.

As best seen in FIG. 9, a rook (R) can bounce by moving to a square occupied by one of its own beasts (W) and then moving at a right angle. The rook moves to a square occupied by one of its own beasts and then moves off that square at a right angle. Two possible trajectories are shown. Since, in this instance, the rook approaches the beast square along a file, when it comes to the beast square it can bounce and move in either direction along the rank on which the beast sits.

Figure 10:
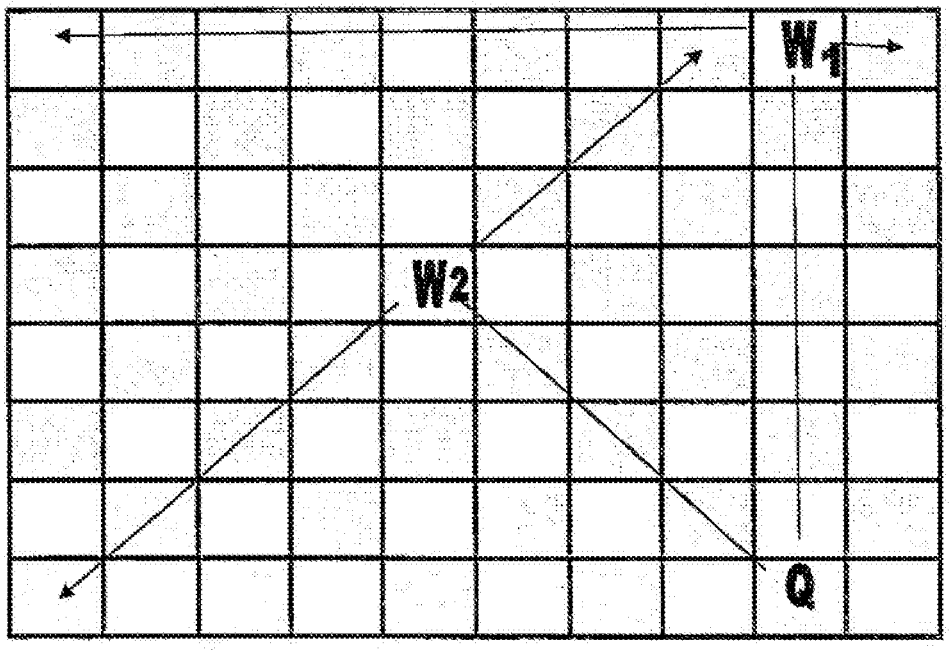
FIG. 10 is a diagram illustrating permissible movements of a queen using a beast in the modified chess game of the present invention.

A queen can bounce by moving to a square occupied by a beast of the same color and then moving off at a right angle. If the queen moves to the beast along a diagonal, it can bounce only along a diagonal. If it moves to the beast square orthogonally, i.e., along a rank or file, it must bounce along a rank or file. For instance, if it came to the beast along a file, it could bounce by then turning at a right angle and moving along the rank on which the beast is situated. The queen cannot approach the beast square diagonally and then bounce orthogonally or vice versa. In understanding this restriction, it may help to remember that in orthodox chess a queen may move like a bishop or like a rook but not both ways on the same turn. FIG. 10 illustrates this distinction. In FIG. 10, when the queen (Q) approaches the square occupied by the beast marked W.sub.1, it moves orthogonally, like a rook along a file and must move orthogonally like a rook along a rank in order to bounce. In contrast, the queen (Q) moves diagonally like a bishop to the square occupied by the beast marked W.sub.2 and hence must move diagonally at a right angle to the original line of movement when it bounces.

Figure 11:
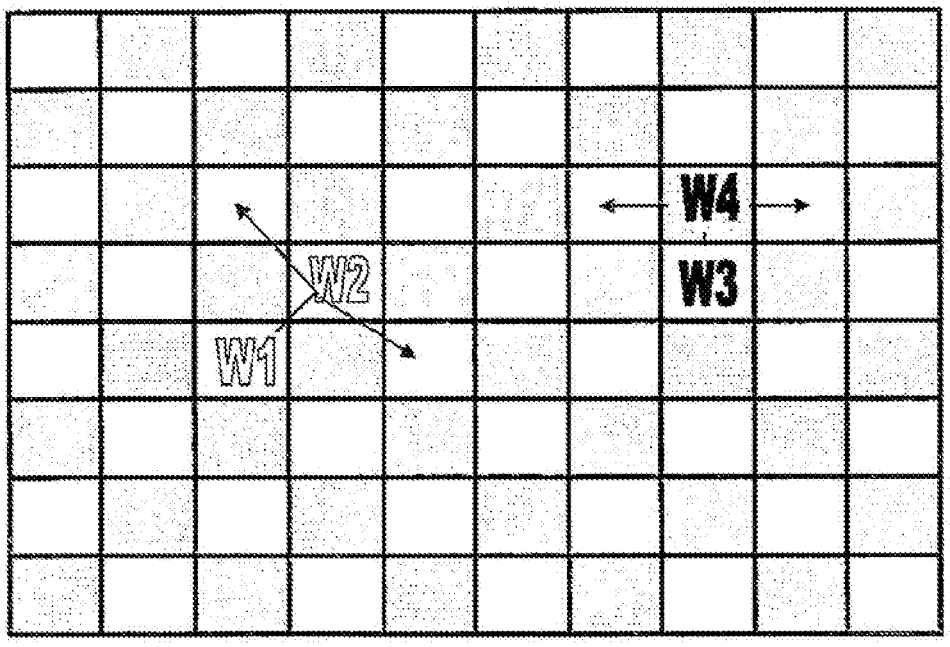
FIG. 11 is a diagram illustrating permissible movements of a beast in conjunction with another beast.

A beast may make a bounce by moving one square to a square occupied by another beast of the same color and then moving off at a right angle. It cannot hop or capture on the same turn. FIG. 11 shows two examples of a beast bouncing off another beast of the same color. The beast marked W1 moves one square along a diagonal to the square occupied by the beast marked W2, bounces off W2, and moves one square at a right angle along another diagonal, ending up on either of the next nearest squares on that second diagonal. The beast labeled W3 moves one square along a file to the square occupied by the beast labeled W4, bounces off of W4, and moves one square at a right angle along the rank on which W4 is sitting, ending up on that rank on either of the two squares adjacent to the square of W4.

A knight, bishop, rook or queen can 'propel' a beast of the same color. This could be considered a two part turn. First the piece moves unto the square of the beast, and then the beast moves as though it were that piece. However, a propelled beast is not allowed to capture on that turn. A propelled beast could move forward, backward, or sideways. It may, for instance, follow in reverse the trajectory of the propelling piece and land on the square originally occupied by that piece or further back.

Figure 12:
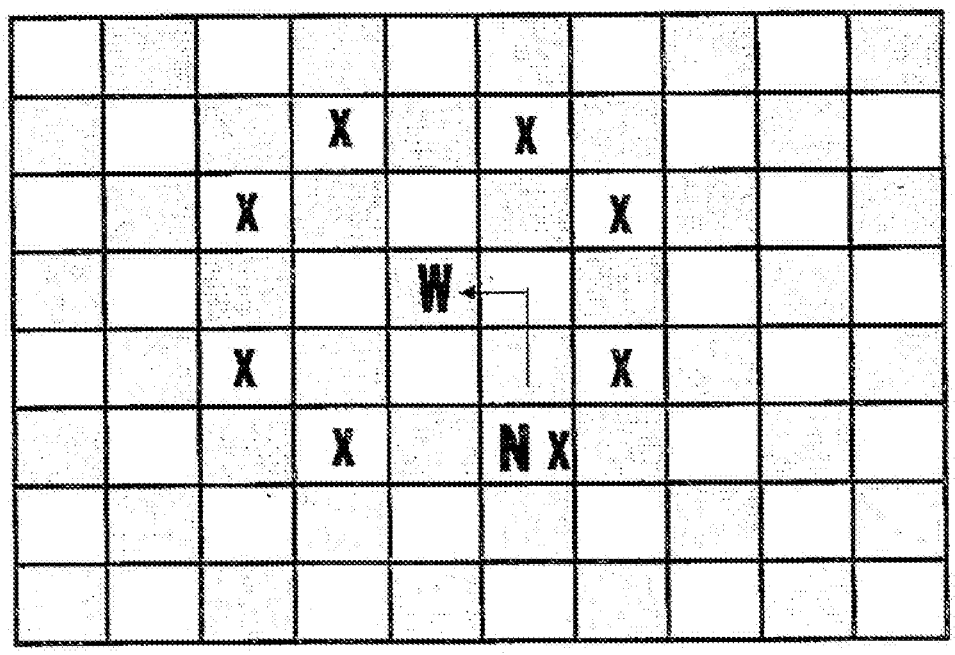
FIG. 12 is a diagram illustrating the squares to which a beast could move when involved with a knight in a maneuver referred to as 'propelling'.

FIG. 12 shows the squares, marked X, to which a beast (W) could move if propelled by a knight (N). Note this includes the square on which the knight was previously situated.

Figure 13:
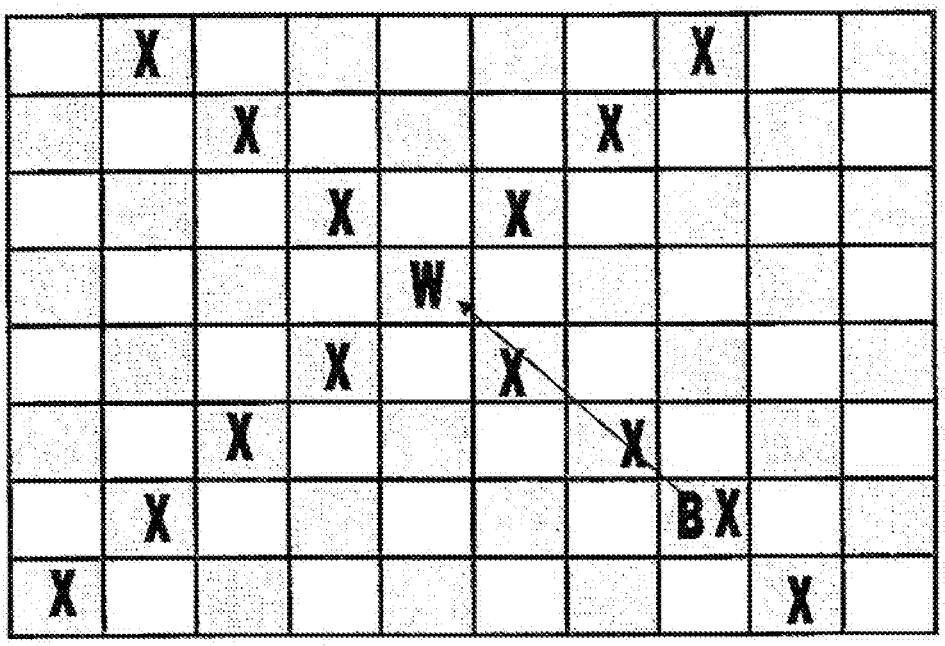
FIG. 13 is a diagram illustrating the squares to which a beast 'propelled' by a bishop could move.

FIG. 13 shows the squares, marked X, to which a beast (W) propelled by a bishop (B) could move. Note that this includes the square the bishop occupied at the beginning of the turn.

Figure 14:
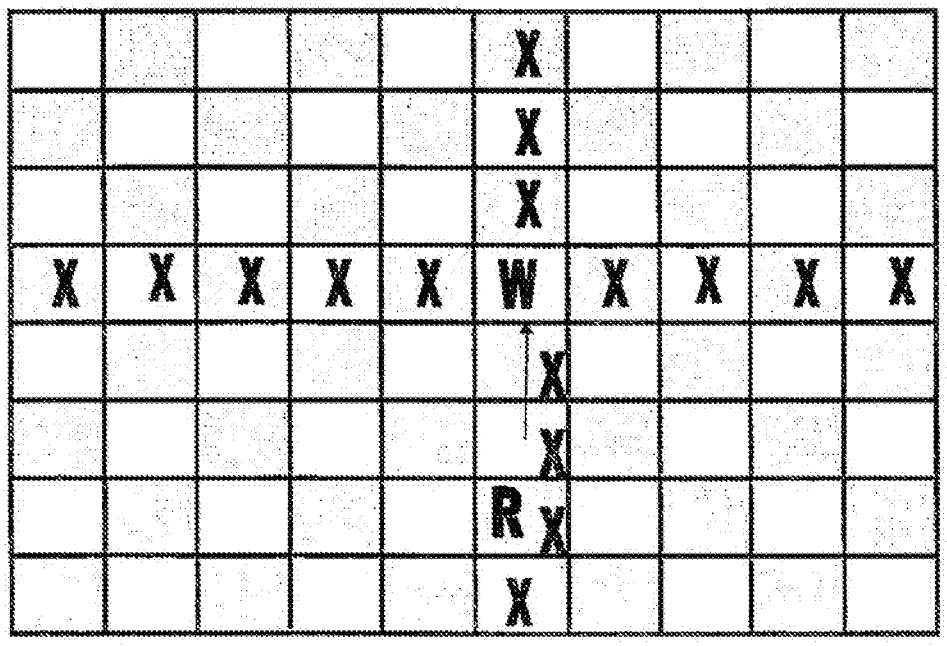
FIG. 14 is a diagram illustrating the squares to which a beast propelled by a rook could move.

FIG. 14 shows the squares, marked X, to which a beast (W) propelled by a rook (R) could move. Note that this includes the square the rook occupied at the beginning of the turn.

Figure 15:
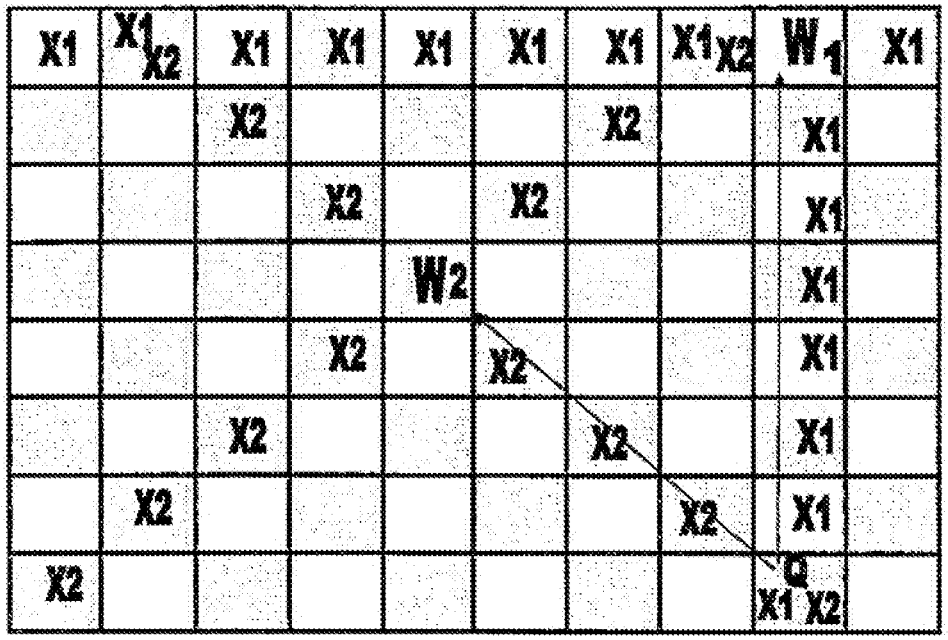
FIG. 15 is a diagram illustrating the options involved when a queen could propel either of two beasts.

A beast propelled by a queen would move diagonally like a bishop if the queen had come to the beast square along a diagonal like a bishop and like a rook if the queen had come along a rank or file. FIG. 15 shows the queen (Q) having the option of propelling either of two beasts, W.sub.1 and W.sub.2. If propelled, W.sub.1 could move to the square previously occupied by the queen or any of the squares labeled X1. On the other hand, if the queen moves to the square occupied by W.sub.2, W.sub.2 could move to the square occupied previously by the queen or to any of the squares marked X.sub.2.

A king cannot propel a beast.

A beast cannot propel another beast per se, but a beast passing through or bouncing off another beast could have a similar effect.

Figure 16:
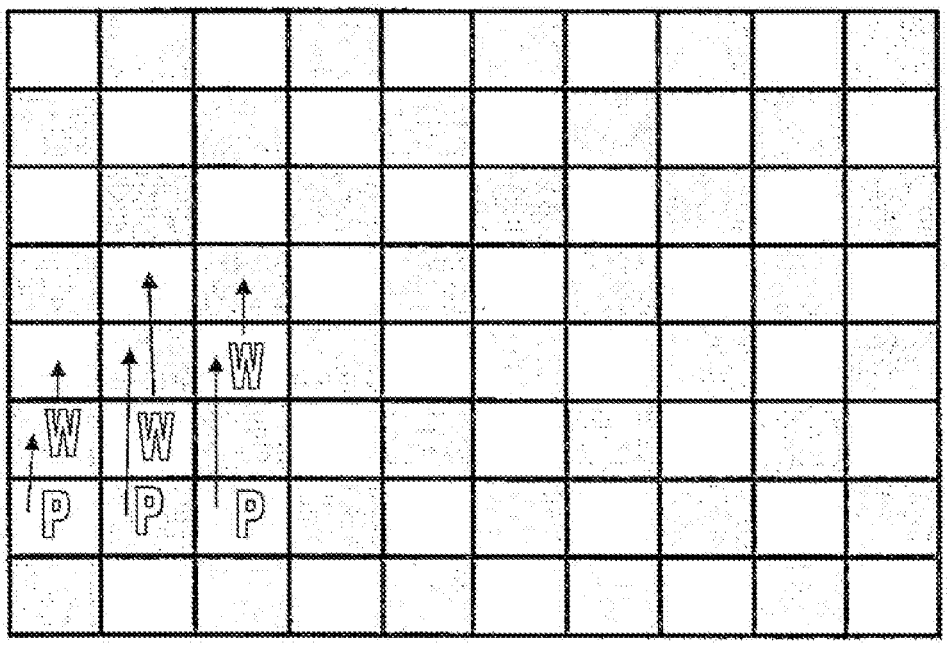
FIG. 16 is a diagram illustrating various propelling options involving a pawn and beast.

A pawn may propel a beast but only on the pawn's first move and only one or two squares vertically forward along the same file. The propelled beast would end up on the square just in front of the pawn. For example, if a pawn is at square A2 and a beast of the same color at square A3, the pawn could move to A3 and propel the beast to A4, or move to A4 and propel the beast to A5. If a pawn is at square A2 and a beast at A4, the pawn may move to A4 and propel the beast to A5. Neither the pawn nor the beast could move through or capture other pieces that turn. FIG. 16 shows various propelling options involving a pawn and a beast. In the first file (column), the pawn is initially on the second rank and the beast on the third rank. The pawn moves up one square to the third rank and propels the beast to the fourth rank. In the second file, the pawn is initially on the second rank and the beast on the third rank. The pawn moves up two squares to the fourth rank and propels the beast to the fifth rank. In the third file, the pawn is initially on the second rank and the beast on the fourth rank. The pawn moves up two squares and propels the beast to the fifth rank.

A piece that can propel as described above, may come to the beast square by means of a bounce and then propel the beast. A bounce may proceed a propelling on the same turn. Likewise, a propelled beast may bounce in the same manner the propelling piece would bounce. But there may not be more than one bounce or one propelling on a given turn. In an alternative approach to provide simplification, a piece may not be permitted to both bounce and propel in the same turn.

The capture of an enemy piece, including a pawn, ends the player's turn.

Figure 17:
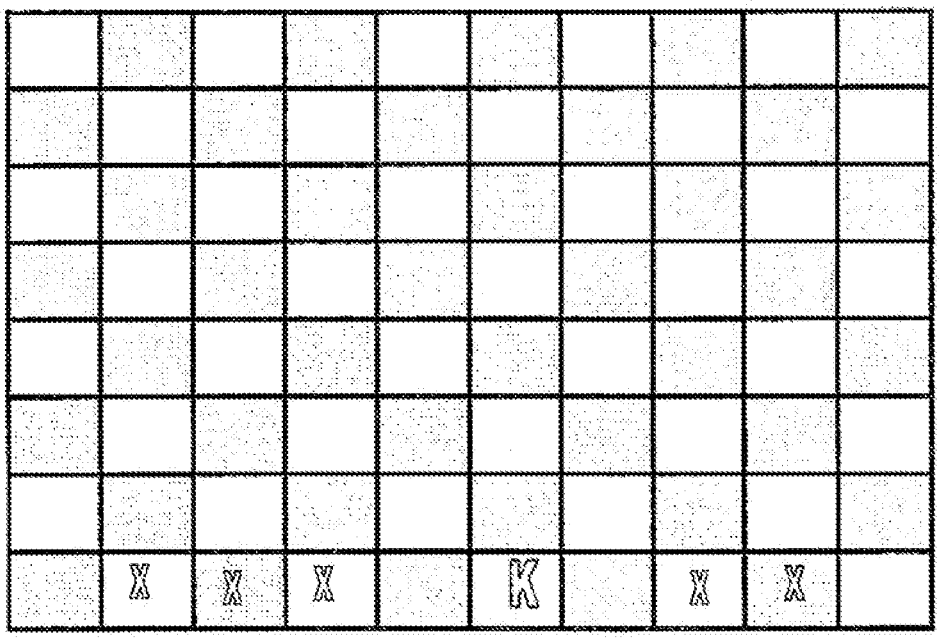
FIG. 17 is a diagram illustrating the various squares to which a king could move when castling.

A player shall have the right to castle as in conventional chess with a castling rook ending up adjacent to the castled king, but the player has the option to place the king one, two or three squares from the side edge of the board with the rook adjacent if castling queen side and one or two squares from the side edge with the rook adjacent if castling king side. To castle, the king moves at least two squares and cannot move into a corner. The rook moves to a square adjacent to the king but closer to the center of the rank. As in conventional chess, neither the king nor the rook involved can have moved prior to castling. FIG. 17 illustrates the squares, marked X, to which the king (K) could move when castling.

Castling may be done through a beast of the same color, but this is the only time a king can pass through a beast and the beast may not move on that turn. The position of the beast may limit castling options. For instance, if the beast is at I1, the king may castle king side but only with the king ending at H1 and the rook at G1 since the beast occupies I1. Thus, in castling, a king can pass across a square occupied by a beast/AGP of the king's own color even though that square would otherwise be under attack by an opposing piece. The beast/AGP, rather than the opposing piece is considered to control the square. In an alternative approach, the king would be prohibited from crossing a square to castle if the square, although occupied by a beast/AGP of the king's color, was otherwise under attack by an opposing piece.

Figure 18:
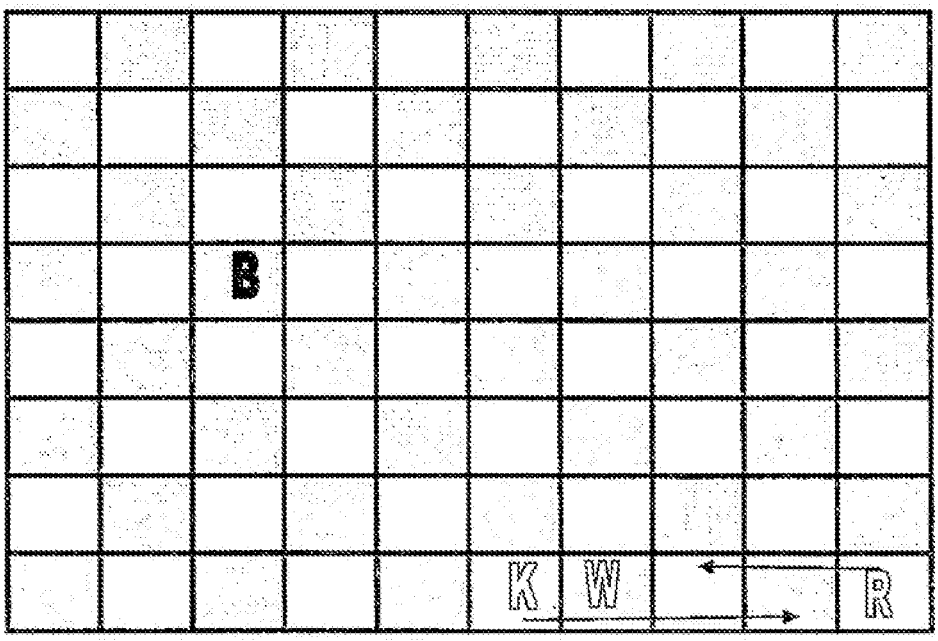
FIG. 18 is a diagram illustrating the ability of a king to castle king side where a beast nullifies the checking power of an opposing piece.

As in conventional chess, a player may not castle when the king is in check or when the king would have to pass through a square where it would be in check. But a king may pass through a square to castle if a beast of the same color occupies that square even if an opposing piece would otherwise check the king on that square. The beast occupying the square nullifies the check. FIG. 18 shows the ability of the king (K) to move through one of its own beasts (W) when castling. It also shows that the king can move through the square protected by the beast that occupies it. The beast nullifies the attack by the opposing bishop (B). If the beast were not there, the king could not castle since it would be passing through check. But the beast rather than the bishop controls that square.

A pawn can promote to a beast when it reaches the other side of the board.

In the preferred embodiment, the board is a rectangle eight squares deep by ten squares wide. The size of the board could be varied however without departing from the invention. For instance, the board could be ten squares wide but nine or ten squares deep.

Figure 19:
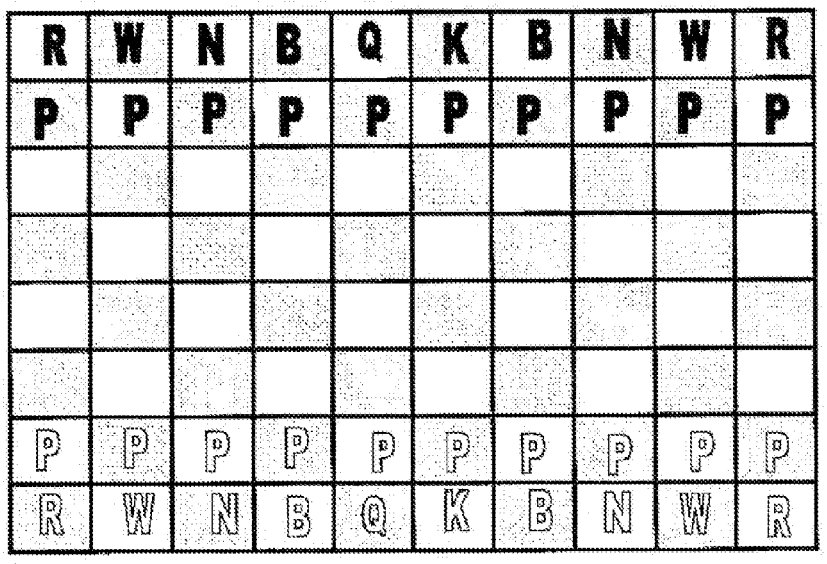
FIG. 19 shows the initial alignment of the pieces in the preferred embodiment.

As shown in FIG. 19, the initial alignment of the pieces in the preferred embodiment is the same as in conventional chess except that beasts shall be placed between the rooks and knights and additional pawns shall be placed in front of the beasts. The alignment could be varied, however, without departing from the invention. In FIG. 19, P denotes a pawn, R denotes a rook, W denotes a beast, N denotes a knight, B denotes a bishop, Q denotes a queen, and K denotes a king While the additional piece W of the present application has been labeled as a "beast" it should be understood that other names such as "wizard" could be used to name the piece W without departing from the scope of the present invention. Any name could be used for the piece. What is important is that it has the powers of the piece W. The use of the term "beast" in the following claims is not intended to limit of the claims to a piece having this name.

Although several variations and modifications of the present invention have been described, it should be apparent to one skilled in the art that other modifications could be made without departing from the spirit of the invention as set forth in the following claims.

Figure 20:
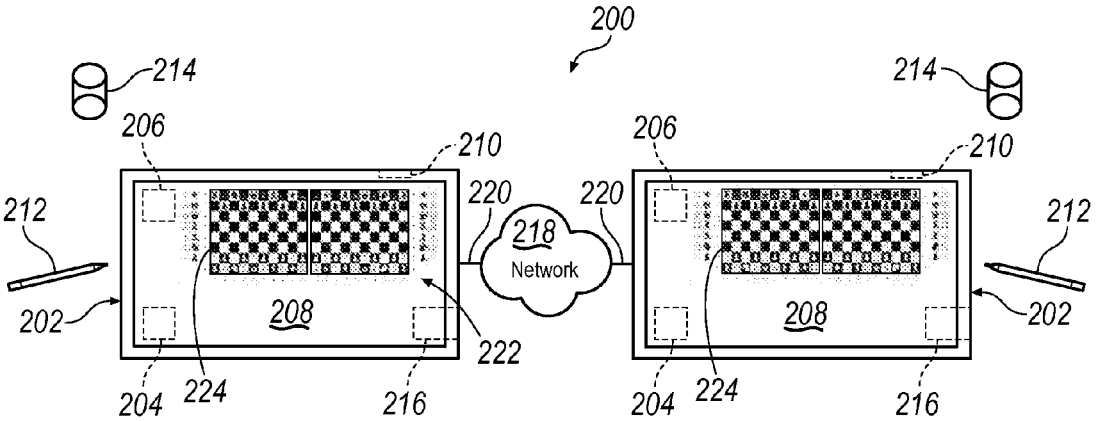
FIG. 20 shows a system for playing the game with two computer devices connected by a data network.

In another illustrative approach as shown in FIG. 20, the game may also be implemented including a system 200 utilizing a local computing device 202 including a processor 204, a memory 206, a display 208, a speaker 210 and a graphical user interface that may operate using an input mechanism 212 such as a finger or stylus gestures performed in combination with the display, which may be a touch screen device. In one example, a player plays against the processor 204, the processor including heuristics to emulate the actions of a second player. The player may set the processor 204 at various play levels (Novice→Expert).

A database 214 may be incorporated into the local computing device 202. The database 214 includes the ability to track specific users, to track players and their performance, piece tracking, analysis storage, and the like. The database 214 is searchable by games saved, board position, player, event, date, rating, and result. In another example the system 200 may also be incorporated into a two player game against another player over a data network 218 using a data connection 220, wherein each of the players uses their own local computing device 202. A connection 220 is established between the two devices 202 by way of data network 218, each of which devices utilizes heuristics configured to communicate with the other device. In one approach address connections are determined using Internet Protocol addresses. When the devices 202 have connected, they shall each send a ready message to their respective player. Protocol messages may be passed between the devices 202 using algebraic chess notation so that a representation of a game being played on one device is replicated on the other device.

Users can save and load games from a memory 216 associated with the local computing device that may be in the form of a selectively removable memory card (e.g., SD card), undo a most recent move, and enter into an analysis mode, where users may analyze their respective matches by stepping through the game. Data representing the interactions associated with a match may be exported to a file and the file saved, shared, or printed. In one illustrative approach, when a user selects a game piece the system 200 shows where the piece can move to by way of display 208. In yet another exemplary approach, users may keep track of a career history against a specific processor 204, other players and the level played at, and ultimately improve their rating.

The display 208 may generate a representation of a game field 222, including the pieces. The pieces may be animated, cells 224 representing squares may light up or change in some manner, and sound may be played when pieces are moved. For example, a sound may be played when a beast is moved and a different sound played when the beast undergoes diagonal hopping, orthogonal hopping, or is captured.

A non-transitory computer-readable medium such as what may be found in memory 206 or memory 216 tangibly embodies computer-executable instructions comprising instructions that when executed by processor cause the processor to generate the game field 222 and permit the game to be played as discussed above using a player versus the processor mode, player versus player mode, or player versus player mode where the players are remote from each other and using their own local computing devices 202.

The exemplary computing systems discussed above may be any computing system and/or device, which includes a processor and a memory (e.g., a central processing unit and memory described below), that enables the computing system in the form of the android device and related components including remote server(s) to acquire, process, and transfer data. In general, computing systems and/or devices may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OS X and iOS operating systems distributed by Apple Inc. of Cupertino, Calif., the BlackBerry OS distributed by Research In Motion of Waterloo, Canada, and the Android operating system developed by the Open Handset Alliance. Examples of computing devices include, without limitation, a computer workstation, a server, a desktop, notebook, laptop, or handheld computer, or some other computing system and/or device.

Computing systems and/or devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, Procedural Language/Structured Query Language (PL/SQL), etc.

The exemplary computing systems may take many different forms and include multiple and/or alternate components and facilities. While exemplary systems are shown in the figures, the exemplary components illustrated are not intended to be limiting. Indeed, additional or alternative components and/or implementations may be used. Further, in some examples, computing system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

The central processing unit (CPU) may be, in general, be any processor or microprocessor that receives instructions from a memory and executes these instructions, thereby performing one or more processes, including one or more of the processes described herein. Such instructions and other data may be stored and transmitted using a variety of computer-readable media. The CPU may also include processes comprised from any hardware, software, or combination of hardware or software that carries out instructions of a computer programs by performing logical and arithmetical calculations, such as adding or subtracting two or more numbers, comparing numbers, or jumping to a different part of the instructions. The CPU may be any one of, but not limited to single, dual, triple, or quad core processors (on one single chip), graphics processing units, visual processing units, and virtual processors.

The memory may be, in general, any computer-readable medium (also referred to as a processor-readable medium) that may include any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include optical or magnetic disks and other persistent memory. Volatile media may include dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

In general, databases, data repositories, or other data stores described herein may include various kinds of mechanisms for storing, providing, accessing, and retrieving various kinds of data, including a hierarchical database, a set of files in a file system, an application database in a proprietary format, a relational database management system (RDBMS), main memory database system (MMDB), etc. Each such data store may generally be included within a computing system employing a computer operating system such as one of those mentioned above, and are accessed via a network or connection in any one or more of a variety of manners. A file system may be accessible from a computer operating system, and may include files stored in various formats.

What is claimed is:

1. A method comprising:

A) providing an 8×10 square game board;

B) placing, on the 8×10 square game board, providing first and opposing sets of game pieces, each set comprising ten pawns, one king, one queen, two rooks, two bishops, two knights, and two additional game pieces ("AGP");

C) placing, on the 8×10 square game board, initially positioning the game pieces with each of the AGP being placed adjacent and between each of the respective rooks and the knights of the first and opposing sets;

D) assigning the AGP of the first set a first property to capture, and be captured by, the AGP of the opposing set;

E) assigning the AGP of the first set a second property to move one square in any direction to land on an unoccupied adjoining square;

F) assigning the game pieces of the first set a third property to leap over the AGP of the first set;

G) assigning the AGP and knights of the first set a forth property to leap over the AGP of the opposing set;

H) assigning the bishops, rooks and queen of the first set a fifth property to bounce off the AGP of the first set;

I) moving, based on the fifth property, at least one of said bishops, rooks and queen of the first set by coming to a square occupied by the AGP of the first set and then moving off with a right angle turn; and J) assigning the knights of the first set a sixth property to bounce off the AGP of the first set; and K) moving, based on the sixth property, at least one of the knights of the first set such that said at least one of the knights bounces off the AGP of the first set by coming to a square occupied by the AGP of the first set and then making an additional right angle turn.

2. The method according to claim 1, further comprising assigning the king and pawns of the first set a seventh property to leap over the AGP of the first set when castling and making a first turn, respectively.

3. The method according to claim 1, further comprising assigning the AGP of the first set additional properties to:

leap over adjoining game pieces diagonally or orthogonally landing on an unoccupied square adjoining the square with the game piece leapt over, leap successively over adjoining game pieces orthogonally or diagonally on the same turn, and leap over the AGP of the opposing set diagonally or orthogonally landing on an unoccupied square adjoining the square with the AGP of the opposing set to be thus able to capture the AGP of the opposing set.

4. The method according to claim 1, further comprising assigning the AGP of the first set a seventh property to bounce off the other of the AGP of the first set by moving one square to a square occupied by the other of the AGP of the first set and then moving off at a third right angle turn one square.

5. The method according to claim 1, further comprising assigning the king of the first set a seventh property to land when castling queen-side on one, two or three squares from the board edge and on one or two squares from the board edge when castling king-side, the king of the first set being able to pass through the AGP of the first set when castling.

6. A method of playing a game, comprising:

A) providing a conventional 8×8 square chess game board with additional two columns to make it a 8×10 square game board;

B) placing, on the 8×10 square game board, providing first and opposing sets of game pieces, each set comprising ten pawns, one king, one queen, two rooks, two bishops, two knights, and two additional game pieces ("AGP");

C) placing, on the 8×10 square game board, initially positioning the game pieces with each of the AGP being placed adjacent and between each of the respective rooks and knights of the first and opposing sets;

D) assigning the AGP of the first set a first property to capture, and be captured by, the AGP of the opposing set;

E) assigning the AGP of the first set a second property to move one square in any direction to land on an unoccupied adjoining square;

F) assigning the game pieces of the first set a third property to leap over the AGP of the first set;

G) assigning the AGP and knights of the first set a forth property to leap over the AGP of the opposing set;

H) assigning the bishops, rooks and queen of the first set a fifth property to bounce off the AGP of the first set;

I) moving, based on the fifth property, at least one of said bishops, rooks and queen of the first set by coming to a square occupied by the AGP of the first set and then moving off with a right angle turn;

J) assigning the knights of the first set a sixth property to bounce off the AGP of the first set; and K) moving, based on the sixth property, at least one of the knights of the first set such that said at least one of the knights of the first set bounces off the AGP of the first set by coming to a square occupied by the AGP of the first set and then making an additional right angle turn.

7. The method according to claim 6, further comprising assigning the king and pawns of the first set a seventh property to leap over the AGP of the first set when castling and making a first turn, respectively.

8. The method according to claim 6, further comprising assigning the AGP of the first set additional properties to:

leap over adjoining game pieces diagonally or orthogonally landing on an unoccupied square adjoining the square with the game piece leapt over, leap successively over adjoining pieces orthogonally or diagonally on the same turn, and leap over the AGP of the opposing set diagonally or orthogonally landing on an unoccupied square adjoining the square with the AGP of the opposing set to be thus able to capture the AGP of the opposing set.

9. The method according to claim 6, further comprising assigning the AGP of the first set a seventh property to bounce off the other of the AGP of the first set by moving one square to a square occupied by the other of the AGP of the first set and then moving off one square.

10. The method according to claim 6, further comprising assigning the king of the first set a seventh property to land when castling queen-side on one, two or three squares from the board edge and on one or two squares from the board edge when castling king-side, the king of the first set being able to pass through the AGP of the first set when castling.

11. The method according to claim 6, wherein the right angle turn includes a knight move.

12. The method according to claim 9, wherein moving off includes a right angle turn.

13. A board game comprising:

A) a playing board having ten squares wide and at least eight squares deep;

B) first and second sets of game pieces, the sets differing from each other by color, each set comprising a king, a queen, two rooks, two bishops, two knights, two additional game pieces ("AGP") and ten pawns;

C) an initial setting placing of the game pieces on said playing board with each of the AGP being placed adjacent and between each of the respective rooks and knights of the first and opposing sets;

D) the AGP of the first set being assigned a first property to capture, and be captured by, the AGP of the opposing set;

E) the AGP of the first set being assigned a second property to move one square in any direction to land on an unoccupied adjoining square;

F) the game pieces of the first set being assigned a third property to leap over or pass through the AGP of the first set;

G) the AGP and knights of the first set being assigned a forth property to leap over the AGP of the opposing set;

H) the bishops, rooks and queen of the first set been assigned a fifth property to bounce off the AGP of the first set;

I) at least one of the bishops, rooks and queen of the first set being moved, based on the fifth property, by coming to a square occupied by the AGP of the first set and then moving off with a right angle turn;

J) the knights of the first set being assigned a sixth property to bounce off the AGP of the first set; and K) at least one of the knights of the first set being moved, based on the sixth property, such that said at least one of the knights of the first set bounces off the AGP of the first set by coming to a square occupied by the AGP of the first set and then making an additional right angle turn.

14. The board game as claimed in claim 13, wherein the king and pawns of the first set are assigned a seventh property to leap over the AGP of the first set when castling and making a first turn, respectively.

15. The board game as claimed in claim 13, wherein the AGP of the first set are assigned additional properties to:

leap over adjoining game pieces diagonally or orthogonally landing on an unoccupied square adjoining the square with the game piece leapt over, leap successively over adjoining game pieces orthogonally or diagonally on the same turn, and leap over the AGP of the opposing set diagonally or orthogonally landing on an unoccupied square adjoining the square with the AGP of the opposing set to be thus able to capture the AGP of the opposing set.

16. The board game as claimed in claim 13, wherein the AGP of the first set is assigned a seventh property to bounce off the other of the AGP of the first set by moving one square to a square occupied by the other of the AGP of the first set and then moving off at a third right angle turn one square.

17. The board game as claimed in claim 13, wherein the king of the first set is assigned a seventh property to land when castling queen-side on one, two or three squares from the board edge and on one or two squares from the board edge when castling king-side, the king of the first set being able to pass through the AGP of the first set when castling.

18. The method as claimed in claim 1, wherein leap over includes pass through without bouncing off the AGP.

19. The method as claimed in claim 6, wherein leap over includes pass through without bouncing off the AGP.

20. The board game as claimed in claim 13, wherein leap over includes pass through without bouncing off the AGP.

* * * * *